US008985433B2

(12) United States Patent
Sutherland

(10) Patent No.: US 8,985,433 B2
(45) Date of Patent: Mar. 24, 2015

(54) CARTON WITH HANDLE

(75) Inventor: Robert L. Sutherland, Kennesaw, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 230 days.

(21) Appl. No.: 13/587,965

(22) Filed: Aug. 17, 2012

(65) Prior Publication Data

US 2013/0043299 A1 Feb. 21, 2013

Related U.S. Application Data

(60) Provisional application No. 61/575,346, filed on Aug. 19, 2011.

(51) Int. Cl.
*B65D 5/00* (2006.01)
*B65D 71/36* (2006.01)

(52) U.S. Cl.
CPC ..... *B65D 71/36* (2013.01); *B65D 2571/00141* (2013.01); *B65D 2571/0045* (2013.01); *B65D 2571/00543* (2013.01); *B65D 2571/00574* (2013.01); *B65D 2571/0066* (2013.01); *B65D 2571/00728* (2013.01)
USPC ..... 229/117.16; 206/141

(58) Field of Classification Search
USPC ..... 229/117.16, 117.17, 117.13; 206/141, 206/427
See application file for complete search history.

(56) References Cited

U.S. PATENT DOCUMENTS 2,718,301 A 9/1955 Palmer
2,785,847 A 3/1957 Forrer
4,558,816 A 12/1985 Wood
4,653,686 A 3/1987 Wood et al.
4,679,726 A 7/1987 Oliff
4,681,252 A 7/1987 Doerr et al.
4,684,059 A 8/1987 Rusnock
4,706,876 A * 11/1987 Wilson ..... 229/117.13
4,728,025 A 3/1988 Oliff
4,728,026 A 3/1988 Schuster
4,784,316 A * 11/1988 Crouch ..... 229/117.13
(Continued)

FOREIGN PATENT DOCUMENTS

WO WO 2006/091318 A1 8/2006
WO WO 2006/127735 A1 11/2006
WO WO 2006127735 A1 * 11/2006

OTHER PUBLICATIONS

International Search Report and Written Opinion for PCT/US2012/051313, dated Nov. 26, 2012.

*Primary Examiner* — Justin Larson
*Assistant Examiner* — Phillip Schmidt
(74) *Attorney, Agent, or Firm* — Womble Carlyle Sandridge & Rice, LLP

(57) ABSTRACT

A carton for carrying a plurality of articles includes a top panel, a first side panel foldably connected to the top panel, and a second side panel foldably connected to the top panel. The carton further includes a handle in at least the top panel. The handle comprises at least one handle flap foldably connected to the top panel at an arcuate fold line. The at least one handle flap is at least partially defined by a cut spaced apart from the arcuate fold line and extending across the top panel and into at least one of the first side panel and the second side panel. The at least one handle flap comprises at least two arcuate cuts for facilitating positioning of the at least one handle flap, each of the arcuate cuts comprises an end that is proximate to and spaced apart from the cut line.

35 Claims, 9 Drawing Sheets

(56) References Cited

U.S. PATENT DOCUMENTS

| | | | | |
|---|---|---|---|---|
| 4,785,991 | A | 11/1988 | Schuster | |
| 4,811,894 | A | 3/1989 | Schuster | |
| 4,838,479 | A | 6/1989 | Wood | |
| RE33,110 | E | 11/1989 | Wood et al. | |
| 4,958,734 | A | 9/1990 | Wood et al. | |
| 4,966,324 | A | 10/1990 | Steel | |
| 4,972,991 | A | 11/1990 | Schuster | |
| 4,974,771 | A | 12/1990 | Lavery | |
| 4,981,253 | A * | 1/1991 | Quaintance | 229/117.13 |
| 5,000,313 | A | 3/1991 | Oliff | |
| 5,002,186 | A | 3/1991 | Cooper | |
| 5,106,014 | A | 4/1992 | Miller | |
| 5,108,030 | A | 4/1992 | Schuster et al. | |
| 5,222,658 | A | 6/1993 | DeMaio et al. | |
| 5,292,059 | A | 3/1994 | Oliff | |
| 5,307,932 | A | 5/1994 | Stout et al. | |
| 5,333,734 | A | 8/1994 | Stout et al. | |
| 5,379,944 | A | 1/1995 | Stout et al. | |
| 5,385,234 | A | 1/1995 | Stout et al. | |
| 5,480,091 | A | 1/1996 | Stout | |
| 5,482,203 | A | 1/1996 | Stout | |
| 5,794,778 | A | 8/1998 | Harris | |
| 5,826,783 | A | 10/1998 | Stout | |
| 5,873,515 | A * | 2/1999 | Dunn et al. | 229/117.13 |
| 5,906,313 | A | 5/1999 | Oliff | |
| 5,915,546 | A | 6/1999 | Harrelson | |
| 5,996,883 | A | 12/1999 | Bates | |
| 6,021,899 | A | 2/2000 | Sutherland | |
| 6,109,438 | A | 8/2000 | Sutherland | |
| 6,126,066 | A | 10/2000 | Peterson et al. | |
| 6,131,803 | A | 10/2000 | Oliff et al. | |
| 6,170,741 | B1 | 1/2001 | Skolik et al. | |
| 6,237,839 | B1 | 5/2001 | Brown | |
| 6,273,330 | B1 | 8/2001 | Oliff et al. | |
| 6,425,520 | B1 | 7/2002 | Peterson | |
| 6,766,940 | B2 | 7/2004 | Negelen | |
| 6,942,140 | B2 | 9/2005 | Merzeau | |
| 7,273,161 | B2 | 9/2007 | Fogle et al. | |
| 7,604,157 | B2 | 10/2009 | Zammit et al. | |
| 7,757,933 | B2 | 7/2010 | Dunn | |
| 7,793,779 | B2 | 9/2010 | Spivey, Sr. et al. | |
| 7,806,314 | B2 | 10/2010 | Sutherland | |
| 8,070,052 | B2 | 12/2011 | Spivey, Sr. et al. | |
| 2004/0074954 | A1 | 4/2004 | Fogle et al. | |
| 2007/0017962 | A1 * | 1/2007 | Russ | 229/117.13 |
| 2008/0099545 | A1 * | 5/2008 | Harrelson | 229/117.13 |

* cited by examiner

CARTON WITH HANDLE

CROSS-REFERENCE TO RELATED APPLICATIONS

This application claims the benefit of U.S. Provisional Application No. 61/575,346, which was filed on Aug. 19, 2011.

INCORPORATION BY REFERENCE

U.S. Provisional Application No. 61/575,346, which was filed on Aug. 19, 2011, is hereby incorporated by reference for all purposes as if presented herein in its entirety.

BACKGROUND OF THE DISCLOSURE

The present disclosure generally relates to cartons for holding beverage containers or other types of articles. More specifically, the present disclosure relates to cartons that include handle features.

SUMMARY OF THE DISCLOSURE

In general, one aspect of the disclosure is generally directed to a carton for holding a plurality of articles. In one example, the carton includes a plurality of panels extending at least partially around an interior of the carton. The plurality of panels comprises a top panel, a first side panel foldably connected to the top panel, and a second side panel foldably connected to the top panel. The carton further includes a handle in at least the top panel. The handle comprises at least one handle flap foldably connected to the top panel at an arcuate fold line. The at least one handle flap is at least partially defined by a cut spaced apart from the arcuate fold line and extending across the top panel and into at least one of the first side panel and the second side panel. The at least one handle flap further comprises at least two arcuate cuts for facilitating positioning of the at least one handle flap and each of the arcuate cuts comprises an end that is proximate to and spaced apart from the cut line.

According to another aspect of the disclosure, a blank for forming a carton includes a plurality of panels comprising at least a top panel, a first side panel foldably connected to the top panel, and a second side panel foldably connected to the top panel. The blank further includes features for forming a handle in at least the top panel. The features for forming the handle comprise at least one handle flap foldably connected to the top panel at an arcuate fold line. The at least one handle flap is at least partially defined by a cut spaced apart from the arcuate fold line and extending across the top panel and into at least one of the first side panel and the second side panel. The at least one handle flap further comprises at least two arcuate cuts for facilitating positioning of the at least one handle flap and each of the arcuate cuts comprises an end that is proximate to and spaced apart from the cut line.

According to yet another aspect of the disclosure, a method of forming a carton for carrying a plurality of articles includes obtaining a blank. The blank comprises a plurality of panels comprising at least a top panel, a first side panel foldably connected to the top panel, and a second side panel foldably connected to the top panel. The blank further comprises features for forming a handle in at least the top panel. The features for forming the handle comprise at least one handle flap foldably connected to the top panel at an arcuate fold line. The at least one handle flap is at least partially defined by a cut spaced apart from the arcuate fold line and extending across the top panel and into at least one of the first side panel and the second side panel. The at least one handle flap further comprises at least two arcuate cuts for facilitating positioning of the at least one handle flap and each of the arcuate cuts comprises an end that is proximate to and spaced apart from the cut line. According to this aspect of the disclosure, the method further includes forming at least a portion of an interior of the carton by folding the first side panel relative to top panel.

Other aspects, features, and details of the present disclosure can be more completely understood by reference to the following detailed description of exemplary embodiments taken in conjunction with the drawings and from the appended claims.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to opening, dispensing, and handling features for cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum beverage cans) as disposed within the carton embodiments. In this specification, the terms "lower," "bottom," "upper" and "top" indicate orientations determined in relation to fully erected and upright cartons.

Figure 1:
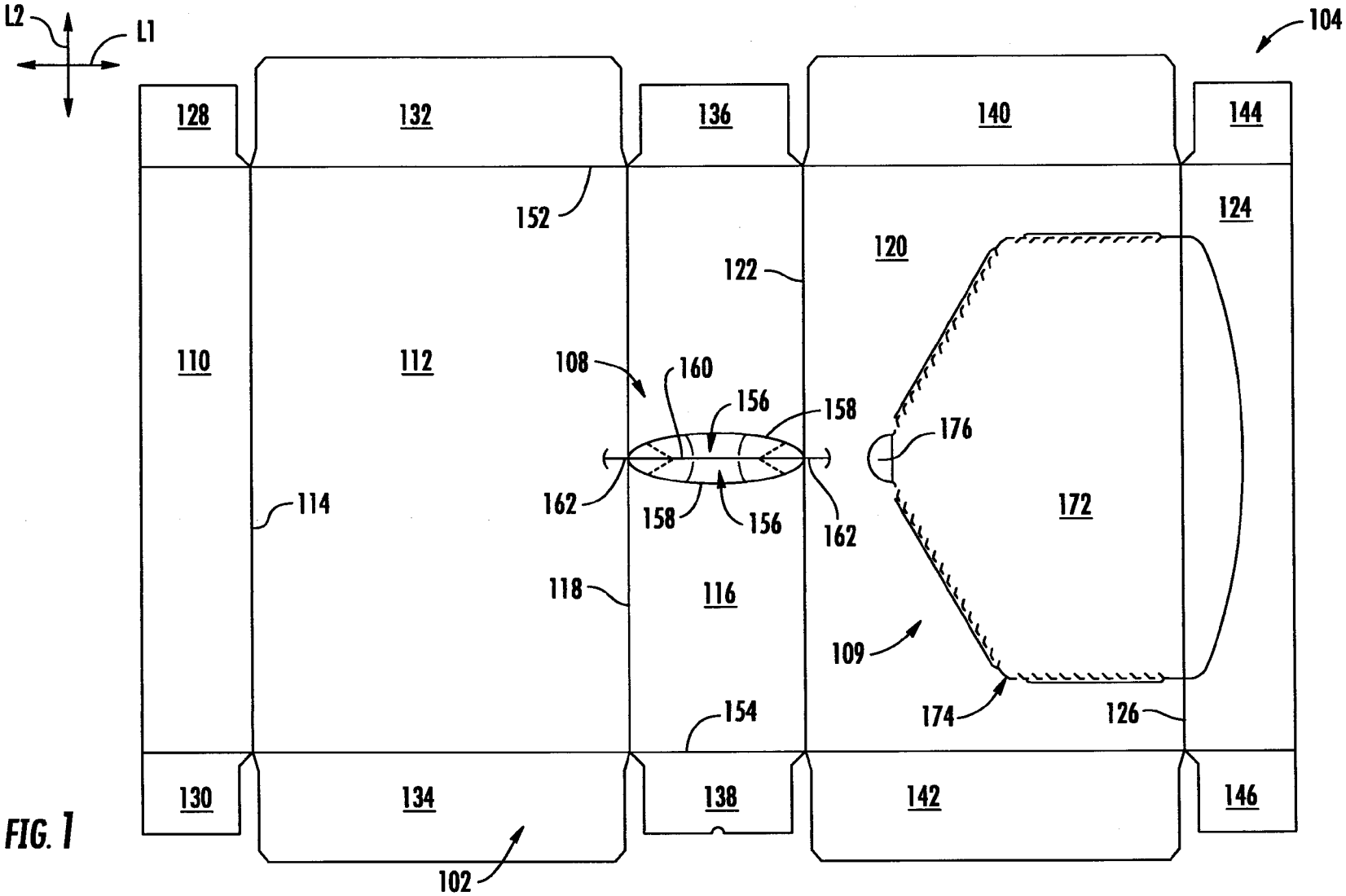
FIG. 1 is a plan view of an exterior surface of a blank according to one embodiment of the disclosure.

FIG. 1 is a plan view of the exterior side 102 of a blank, generally indicated at 104, used to form a carton 106 (FIG. 6) according to an exemplary embodiment of the disclosure. The carton 106 can be used to house a plurality of articles such as containers C (shown by way of example in FIG. 5). In the illustrated embodiment, the containers C are generally cylindrical cans. In the illustrated embodiment, the carton 106 is sized to house twenty-four containers C in a single layer in a 4×6 arrangement, but it is understood that the carton 106 may be sized and shaped to hold containers C of a different or same quantity in more than one layer and/or in different row/column arrangements (e.g., 1×6, 2×4, 3×6, 2×6, 2×6×2, 3×4×2, 2×9, 4×3, etc.). The containers C could be otherwise shaped, arranged, and/or configured without departing from the disclosure. For example, the containers C could be beverage bottles or other containers. In the illustrated embodiment, the carton 106 includes a handle, generally indicated at 108 (FIGS. 1 and 2), for grasping and carrying the carton. Additionally, the carton 106 can include a dispenser 109 for dispensing the containers C from the carton.

The blank 104 has a longitudinal axis L1 and a lateral axis L2. In the illustrated embodiment, the blank 104 comprises a first bottom panel 110 foldably connected to a first side panel 112 at a first lateral fold line 114, a top panel 116 foldably connected to the first side panel 112 at a second lateral fold line 118, a second side panel 120 foldably connected to the top panel 116 at a third lateral fold line 122, and a second bottom panel 124 foldably connected to the second side panel 120 at a fourth lateral fold line 126.

Figure 5:
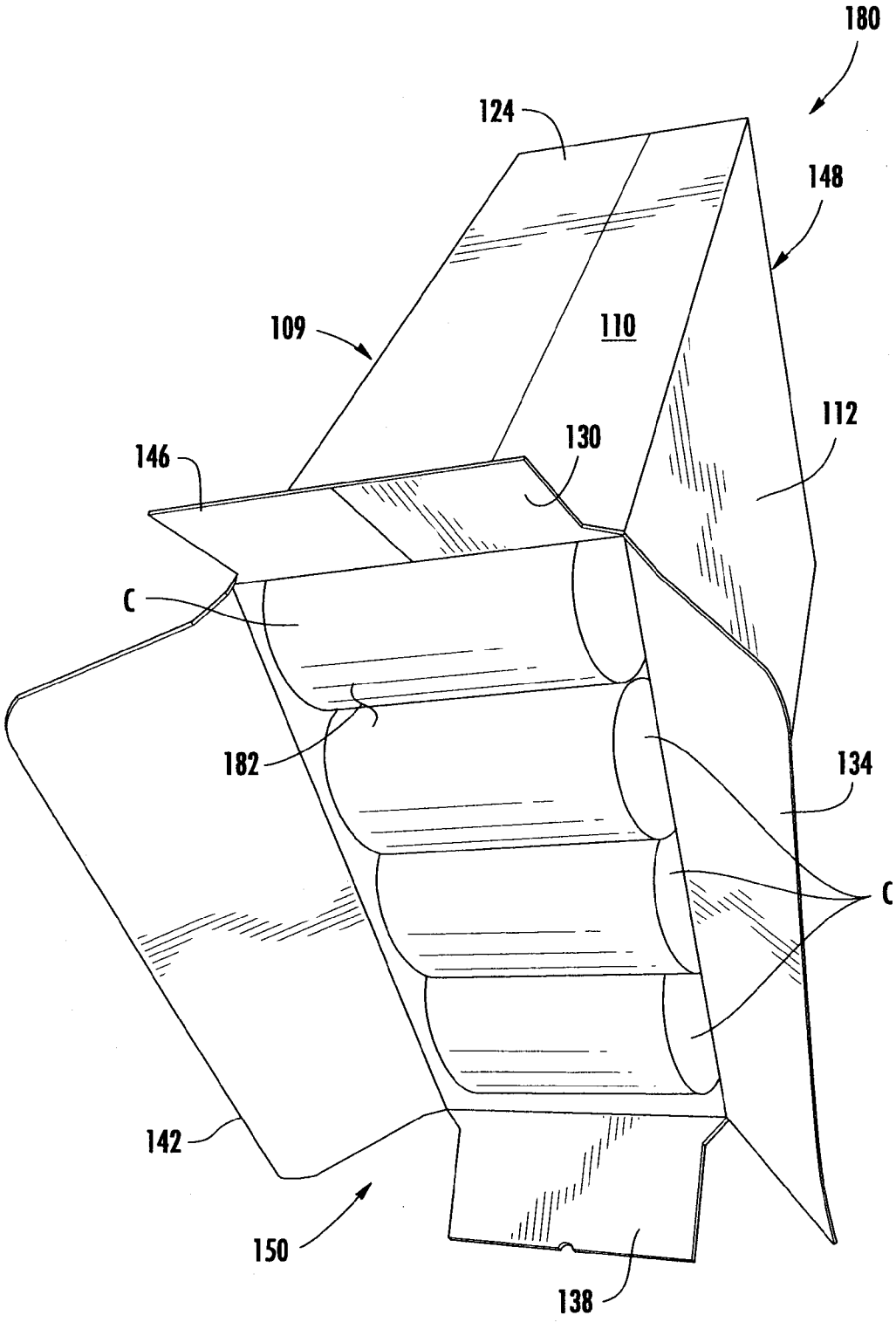
Figure 6:
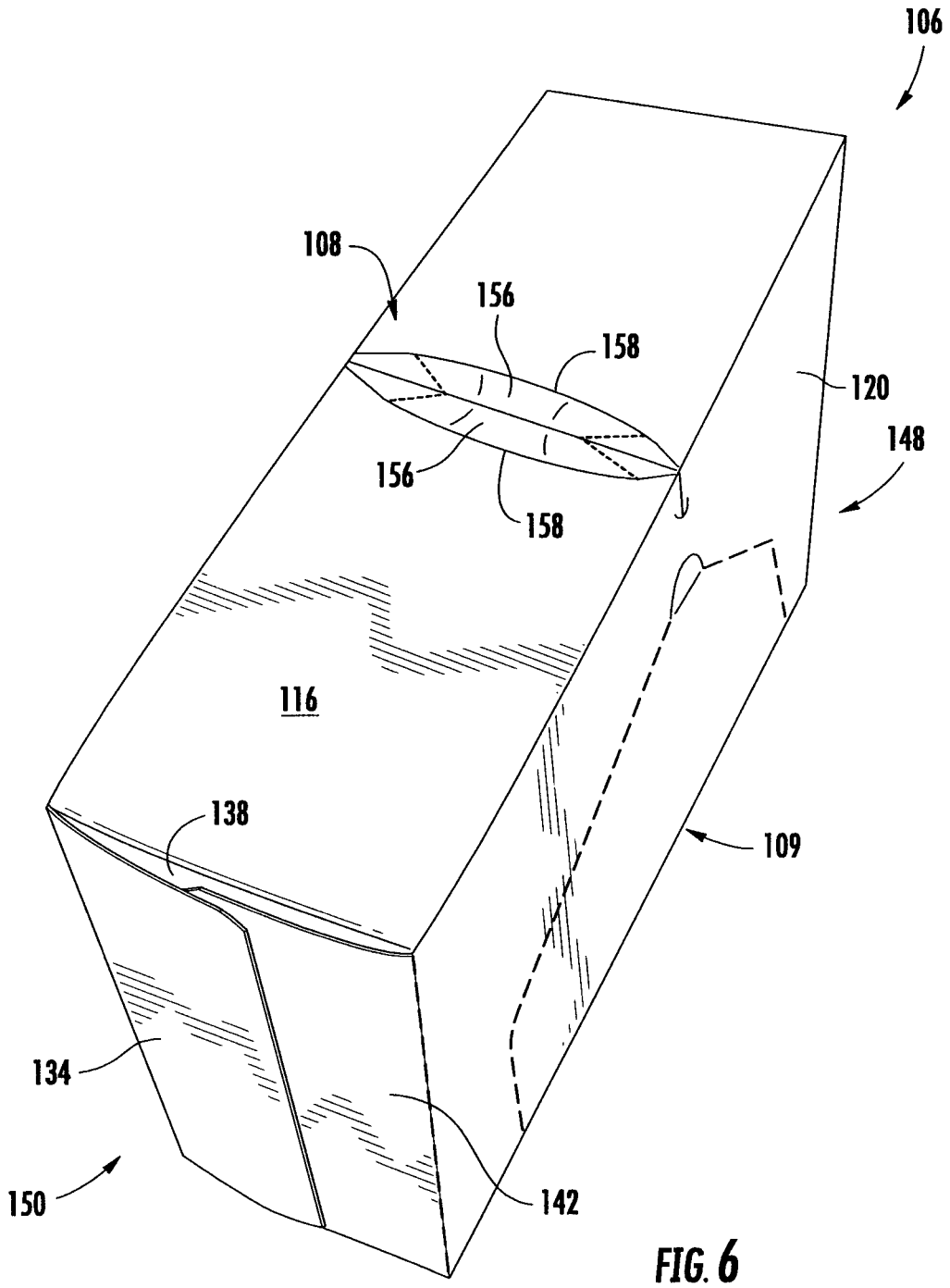
FIG. 6 is a perspective view of the erected carton.
Figure 7:
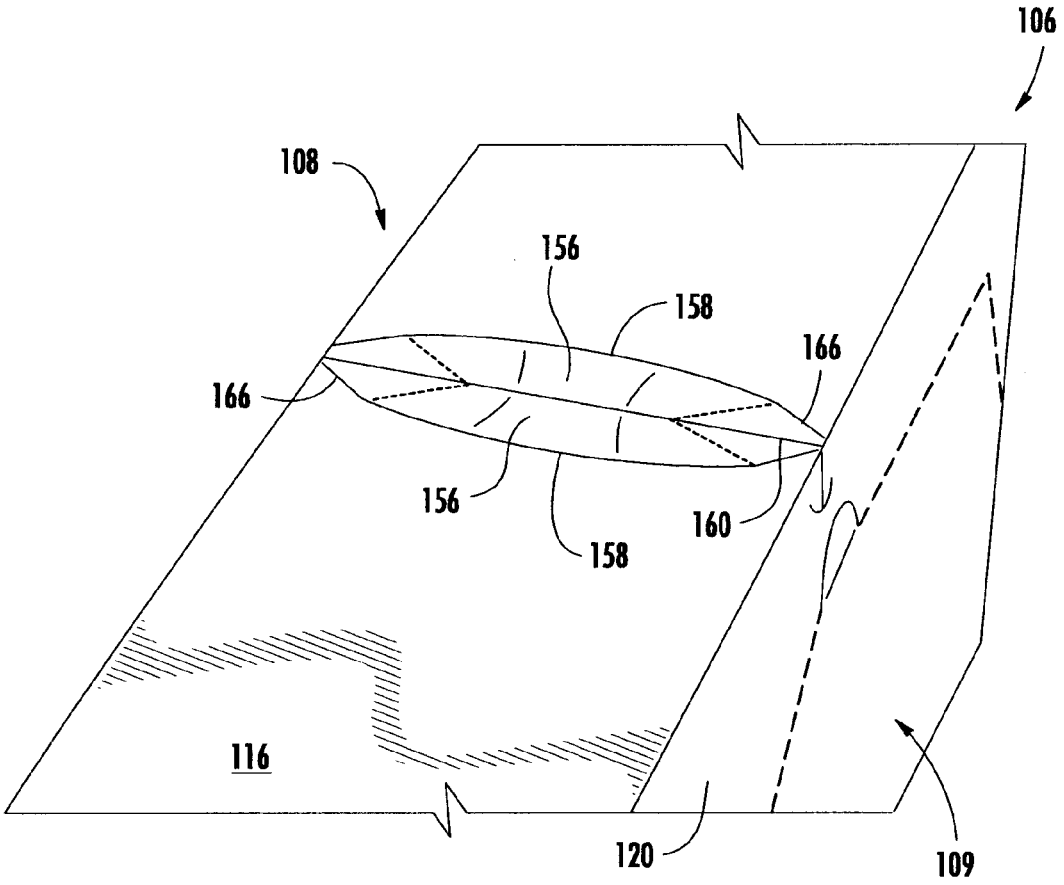
FIG. 7 is a perspective view of the handle of the erected carton of FIG. 6.
Figure 8:
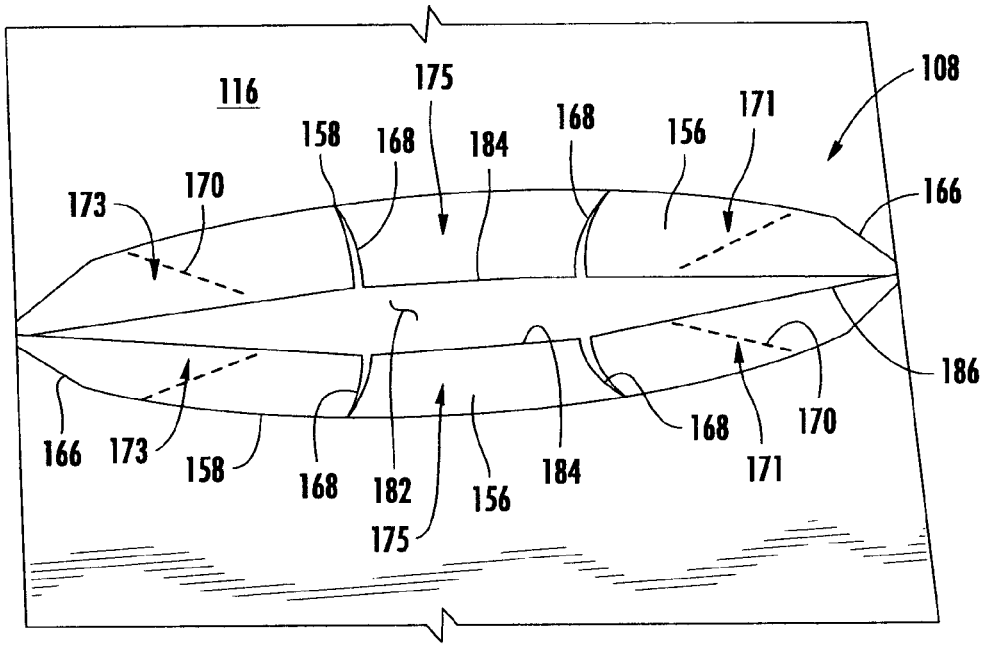

The first bottom panel 110 is foldably connected to a first bottom end flap 128 and a second bottom end flap 130. The first side panel 112 is foldably connected to a first side end flap 132 and a second side end flap 134. The top panel 116 is foldably connected to a first top end flap 136 and a second top end flap 138. The second side panel 120 is foldably connected to a first side end flap 140 and a second side end flap 142. The second bottom panel 124 is foldably connected to a first bottom end flap 144 and a second bottom end flap 146. When the carton 106 is erected, the end flaps 128, 132, 136, 140, 144 close a first end 148 of the carton, and the end flaps 130, 134, 138, 142, 146 close a second end 150 of the carton (FIGS. 5 and 6). In accordance with an alternative embodiment of the present disclosure, different flap arrangements can be used for closing the ends of the carton 106.

The end flaps 128, 132, 136, 140, 144 extend along a first marginal area of the blank 104, and are foldably connected at a first longitudinal fold line 152 that extends along the length of the blank. The end flaps 130, 134, 138, 142, 146 extend along a second marginal area of the blank 104, and are foldably connected at a second longitudinal fold line 154 that also extends along the length of the blank. The longitudinal fold lines 152, 154 may be, for example, substantially straight, or offset at one or more locations to account for blank thickness or for other factors.

Figure 2:
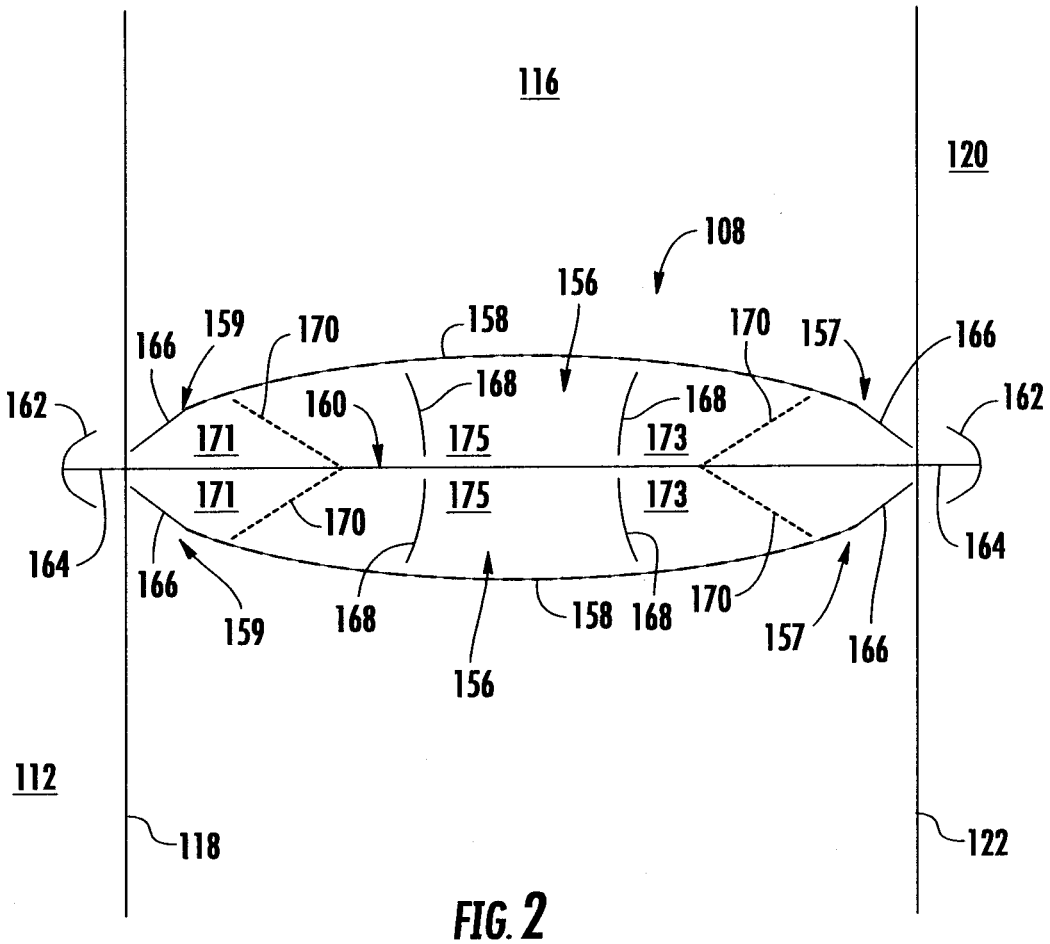
FIG. 2 is a detail view showing handle features of the blank of FIG. 1.

As shown in FIGS. 1 and 2, the blank 104 includes handle features for forming the handle 108 of the carton 106. The handle features include two handle flaps 156 foldably connected to the top panel 116 at respective arcuate fold lines 158 and separable along longitudinal cut line 160, which extends into the first side panel 112 and the second side panel 120. The handle flaps 156 generally extend in the top panel 116 between the transverse fold lines 118, 122. In the illustrated embodiment, a curved score 162 extends in each side panel 112, 120 at or near the respective end portions 164 of the longitudinal cut line 160. The curved scores 162 can act as tear stops to help prevent the side panels 112, 120 from tearing below the curved scores 162 due to separation of the side panels at the end portions 164 of the longitudinal cut line 160 when the handle 108 is used. The end portions 164, or any portion of the longitudinal cut line 160 alternatively can be a tear line or another line or area of weakening without departing from the disclosure. Alternatively, all of the longitudinal cut line 160 can be a tear line or another line or area of weakening without departing from the disclosure. Additionally, the curved scores 162 alternatively can be cuts, tear lines, or another line or area of weakening without departing from the disclosure.

In the illustrated embodiment, the arcuate fold lines 158 are cut-crease fold lines, and an oblique cut line 166 extends from each end 157 and 159 of each arcuate fold line 158 to the lateral fold lines 118, 122 proximate the longitudinal cut line 160. Alternatively, the arcuate fold lines 158 can be scores, creases, or another line or area of weakening without departing from the disclosure. Additionally, the oblique cut lines 166 can be tear lines, scores, or another line or area of weakening without departing from the disclosure. In one embodiment, the oblique cut lines 166 extend from respective ends 157 and 159 to a respective fold line 118, 122. Alternatively, the oblique cuts 166 could be spaced from a respective adjacent fold line 118, 122 and/or spaced from respective ends 157,159.

As shown in FIG. 2, each of the handle flaps 156 includes two arcuate cuts 168 and two oblique fold lines 170. In the illustrated embodiment, each of the arcuate cuts 168 has an end that is proximate to and spaced apart from the longitudinal cut line 160 and an opposing end that is proximate to and spaced apart from the respective arcuate fold line 158. The oblique fold lines 170 are spaced apart from the transverse fold lines 118, 122 and the ends of the arcuate fold lines 158. The oblique fold lines 170 can extend generally from the cut line 160 to the respective arcuate fold lines 158 away from the center of the handle 108. In the illustrated embodiment, the oblique fold lines 170 are perforation lines. Alternatively, the arcuate cuts 168 and the oblique fold lines 170 can be scores, creases, tear lines or another line or area of weakening without departing from the disclosure. Additionally, the arcuate cuts 168 alternatively can intersect the longitudinal cut line 160 and/or the respective arcuate fold line 158. In the illustrated embodiment, the arcuate cuts 168 and the oblique fold lines 170 of one handle flap 158 are generally aligned with the respective arcuate cuts 168 and the oblique fold lines 170 of the other handle flap 156 so that the handle flaps 156 are generally symmetric.

In the illustrated embodiment, the arcuate cuts 168 can help the handle flaps 156 fold along the arcuate fold lines 158 to form curved edges at the respective arcuate fold lines 158. The curved edges can be more comfortable for a hand to grasp when the handle flaps are folded downwardly. The curve of the arcuate cuts 168 allows the top panel 116 to fold outwardly at the arcuate fold lines 158 while helping to avoid pinching of the handle flaps 156 or the top panel 116. Additionally, the arcuate cuts 168 and the oblique fold lines 170 help to allow the handle flaps 156 to fold and bend around an adjacent container C as the handle flaps are folded inwardly and upwardly against the interior surface of the top panel 116. In one embodiment, a middle portion 175 of one or both of the handle flaps 156 can separate from respective end portions 171 and 173 of the respective handle flap 156 along the arcuate cuts 168 so that the middle portion 175 of the handle flap can fold generally independently with respect to the end portions 171 and 173 of the handle flap. Therefore, the arcuate cuts 168 divide each handle flap into three independently foldable portions 171, 173, and 175. For example, the middle portion 175 of one of the handle flaps 156 can be folded inwardly and upwardly against the interior surface of the top panel 116 while the end portions 171 and 173 of the same handle flap are not folded against the interior surface of the top panel 116. The handle 108 could be otherwise shaped, arranged, positioned, configured, or omitted without departing from the disclosure.

In the illustrated embodiment, a dispenser 109 can extend in the second side panel 120 and the second bottom panel 124. The dispenser 109 can include a dispenser panel 172, which can be separable from the second side panel 120 and the second bottom panel 124 along a tear line 174 to form a dispenser opening (not shown) in the carton 106. The dispenser 109 can include an access tab or finger panel 176 in the second side panel 120. Alternatively, the access tab 176 could be replaced by an access flap foldably connected to the second side panel 120 or an access aperture for facilitating the initiation of the tearing of the dispenser along the tear line 174. Further, the tear line 174 can be, for example, a single tear line, multiple segmented tear lines, or a series of cut lines. The dispenser 109 can be otherwise shaped, arranged, positioned, and/or configured without departing from the disclosure. Alternatively, the dispenser 108 can be omitted without departing from the disclosure.

Figure 3:
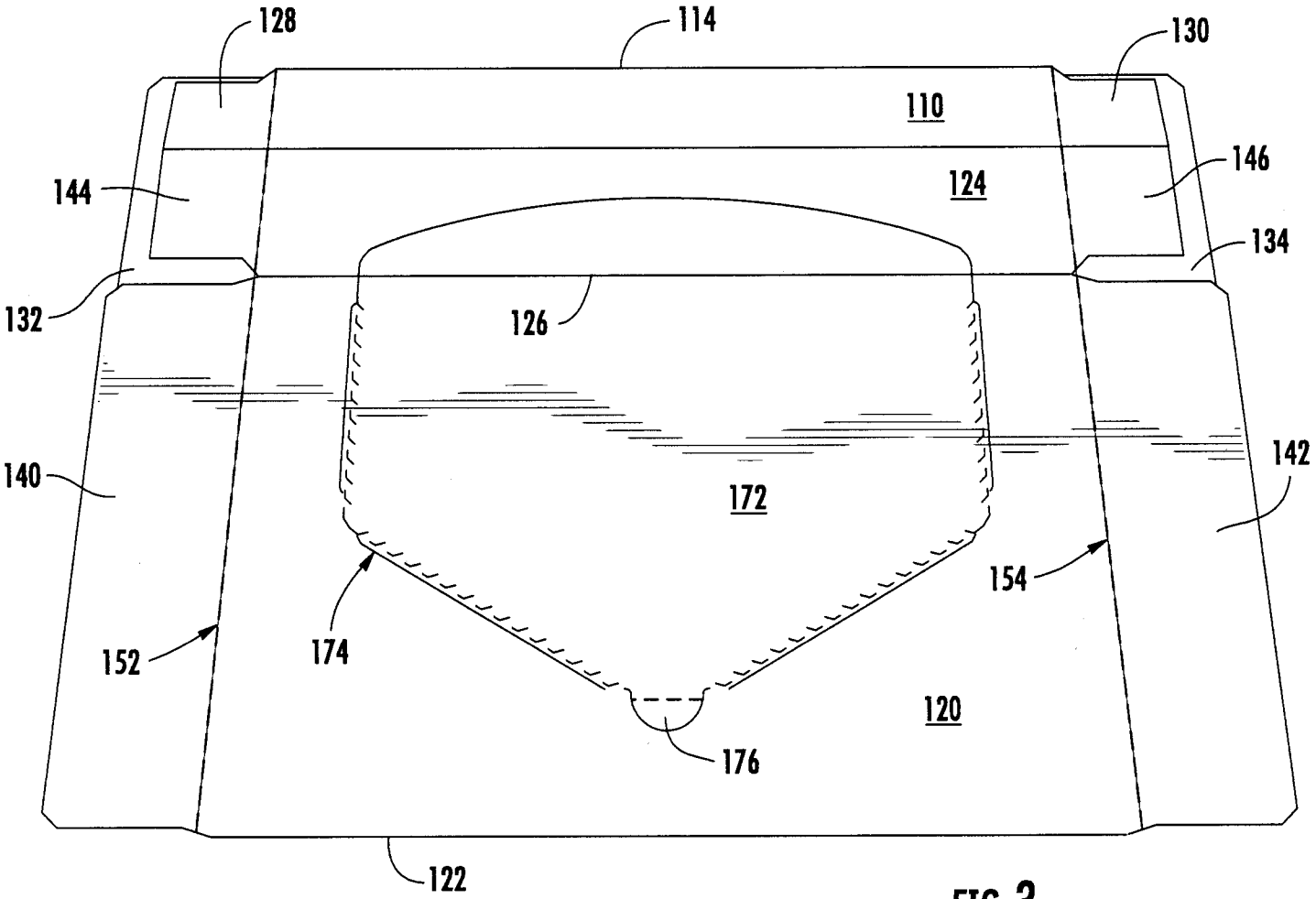
FIGS. 3-5 are views showing steps of erecting a carton from the blank of FIG. 1.
Figure 4:
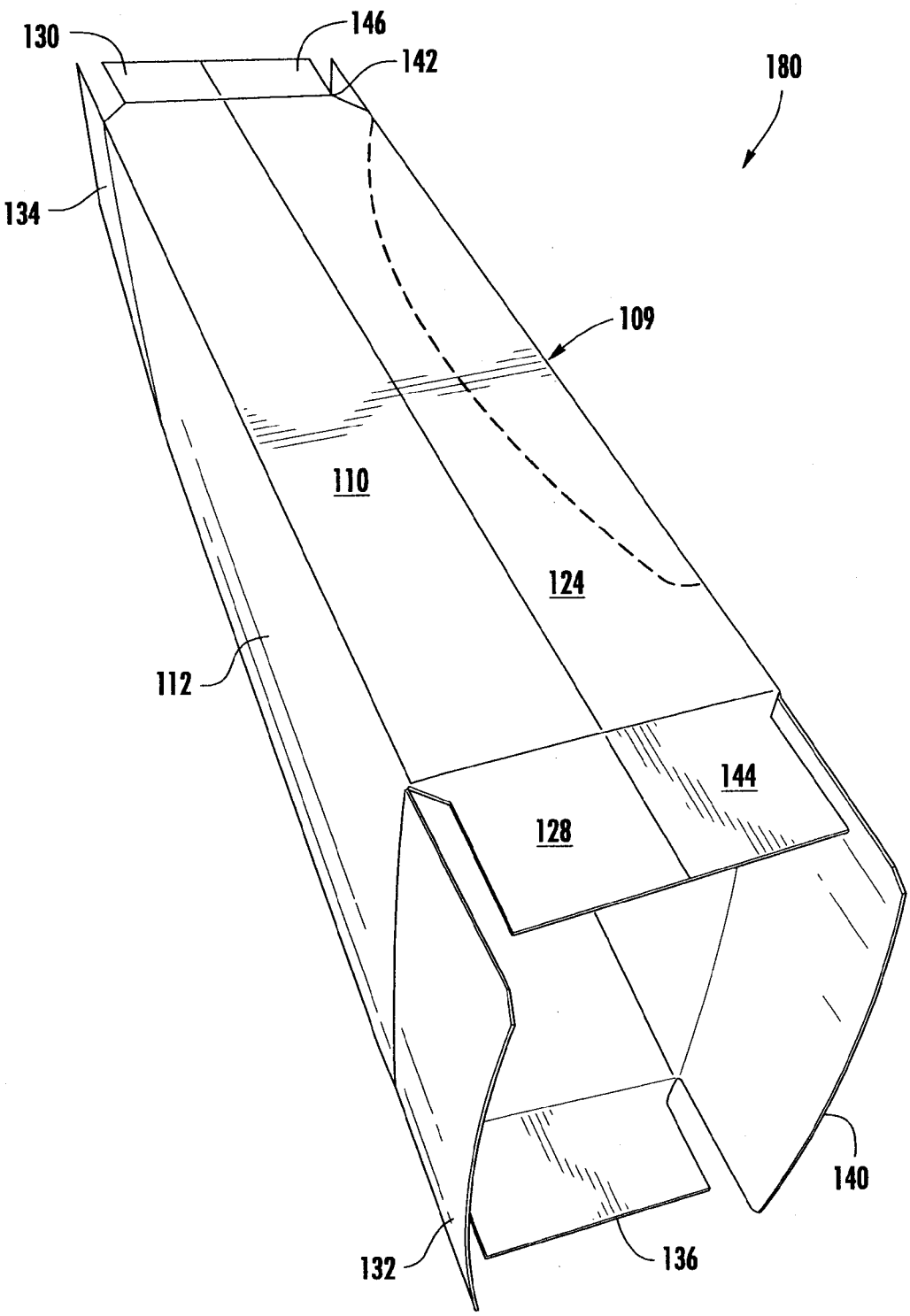

In accordance with the exemplary embodiment, the blank 104 can be erected into the carton 106, as shown in FIGS. 3-6, by folding the first bottom panel 110 along the first lateral fold line 114 so that the first bottom panel 110 is in face-to-face contact with the interior surface of the first side panel 112 and the second side panel 120 and the second bottom panel 124 are folded along the third lateral fold line 122 so that a portion of the second bottom panel is in face-to-face contact with the exterior surface of a portion of the first bottom panel 110 (FIG. 3). The second bottom panel 124 can be glued or otherwise fastened to the first bottom panel 110 such as along a glue strip. As shown in FIG. 4, the blank 104 can be folded along fold lines 114, 118, 122, 126, to form a partially-erected carton in the form of an open-ended sleeve 180 with an interior 182. The sleeve 180 can be otherwise formed or arranged without departing from the disclosure.

In the illustrated embodiment, the first end 148 of the carton 106 is closed by respectively overlapping and adhering the end flaps 128, 132, 136, 140, 144 (FIGS. 5 and 6). Similarly, the second end 150 of the carton 106 is closed by respectively overlapping the end flaps 130, 134, 138, 142, 146 after loading the containers C into the sleeve 180 (FIG. 5). The closed second end 150 is shown in FIG. 6. Other closing and loading sequences can be used without departing from the disclosure. For example, the containers can be loaded into the carton 106 after closing the first end 148 or the second end 150 or before closing either end.

As shown in FIG. 5, the containers C can be loaded into the sleeve 180 so that the tops or bottoms of the containers C are adjacent the first side panel 112 or the second side panel 120 and the cylindrical length of each container C is generally parallel to the top panel 116 and the bottom panels 110, 124. The side panels 112, 120 and the ends 148, 150 of the carton 106 extend generally vertically between the top panel 116 and the bottom panels 110, 120. Alternatively, the carton 106 can have tapered sides or ends where the bottom wall formed from the overlapped bottom panels 110, 124 is both longer and/or wider in the directions L1, L2 than the top panel 116. A three-sided taper carton, for example, can have ends 148, 150 angling inwardly and at least an upper portion of the first side panel 112 could be angled inwardly. In another alternative, the corners of the carton 106 between the top panel 116 and each end 148, 150, and between the bottom panels 110, 124 and each end 148, 150 can be angled or curved to generally follow the contour of the containers C at the corners of the carton.

Figure 9:
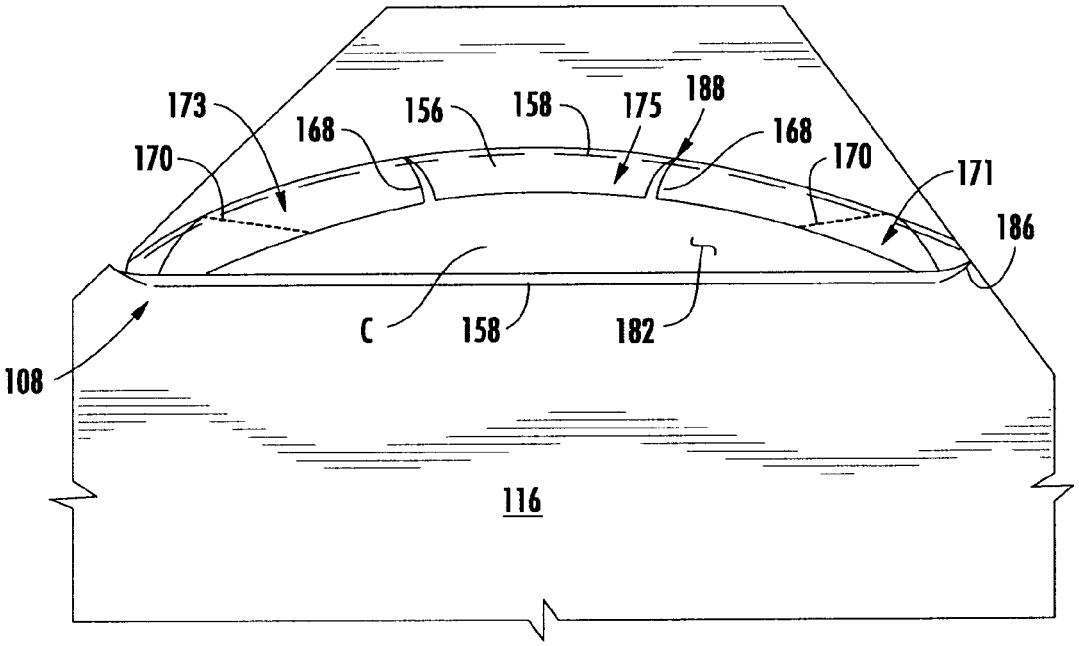
FIGS. 9-11 are perspective views of the erected carton of FIG. 6 showing activation of the handle according to one embodiment of the disclosure.
Figure 10:
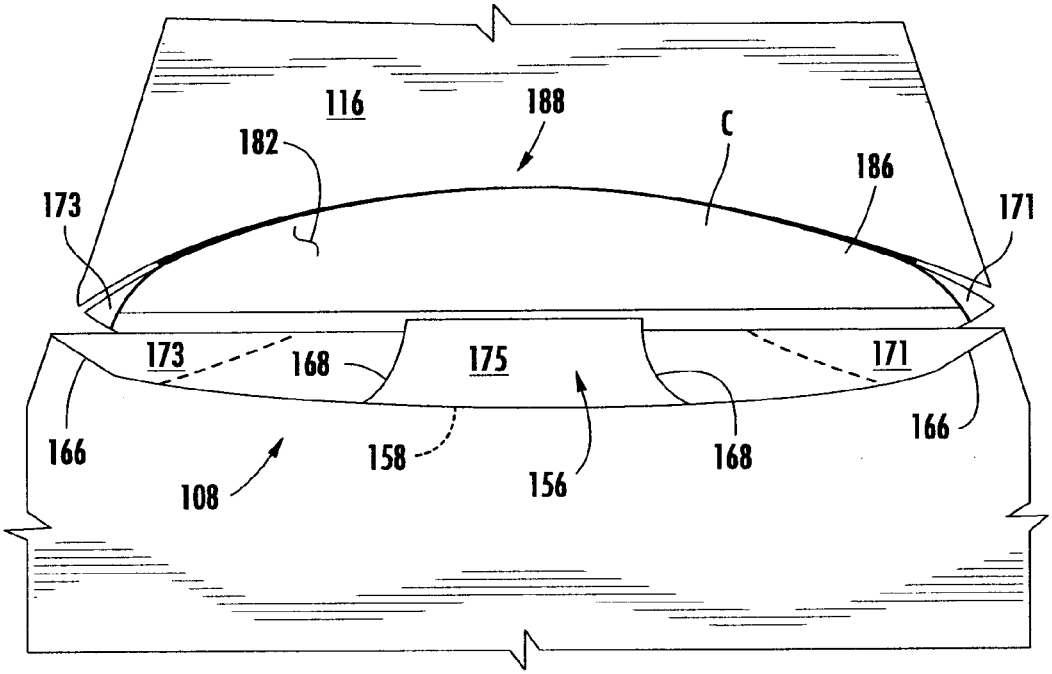

In the illustrated embodiment, the handle 108, shown in the erected carton 106 in FIGS. 6-11, can be generally centered in the top panel 116 along the lateral or L2 direction so that the longitudinal cut line 160 is generally centered between two containers C in the carton 106 adjacent the top panel 116. Accordingly, the handle flaps 156 can be folded along the arcuate fold lines 158 into the interior 182 of the carton 106 forming longitudinal free edges 184 of the handle flaps 156 and a handle opening 186 (FIG. 10). As the handle flaps 156 are pushed inwardly, such as by a user's hand, the handle flaps 156 curve along the arcuate fold lines 158. In the illustrated embodiment, the arcuate cuts 168 and the oblique fold lines 170 allow the handle flaps 156 to bend and help avoid pinching of the handle flaps 156 and/or the top panel 116. The arcuate cuts 168 and the oblique fold lines 170 can also help the handle flaps 156 pivot past the containers C adjacent the handle 108. One or both of the folded handle flaps 156 can tear at the ends of one or more arcuate cuts 168 at the respective longitudinal free edges 184 of the handle flaps 156 so that the resulting segments of the handle flaps can fold relatively independently of one another along the arcuate fold lines 158.

Figure 11:
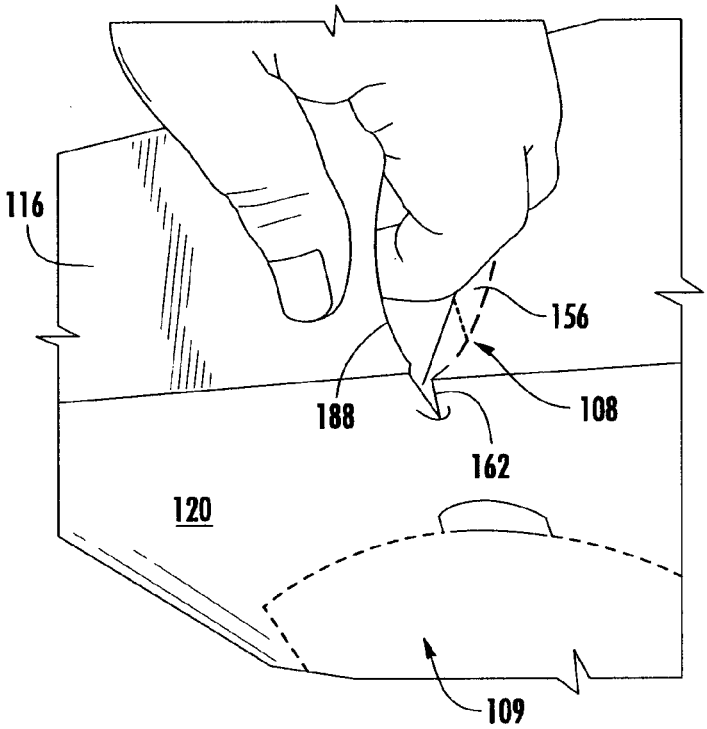

As shown in FIGS. 9 and 11, one or both of the handle flaps 156 can be folded inwardly against the interior surface of the top panel 116 to form a curved edge 188 in the top panel 116 at the fold line 158. A user can grasp the handle 108 at the curved edge 188, and the curved shape of the edge 188 is generally comfortable for the user's hand. As a hand is inserted into the handle opening 186 or as the top panel 116 is pulled upwardly at the handle 108 to carry the carton 106, the side panels can separate at the end portions 164 of the longitudinal cut line 160. However, the curved scores 162 can help prevent the side panels from tearing below the curved scores as the carton 106 is carried. The handle 108 could be otherwise shaped, arranged, positioned, configured, or omitted without departing from the disclosure. Additionally, the handle 108 can be otherwise used or activated without departing from the disclosure.

The configuration of the panels and flaps of the blank 104 and the carton 106 of the illustrated embodiment is included by way of example. The handle 108, for example, can be included in a blank or carton having substantially any configuration.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blank may then be coated with a varnish to protect information printed on the blanks. The blank may also be coated with, for example, a moisture barrier layer, on either or both sides of the blanks. The blank can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding thereal-ong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for carrying a plurality of articles, the carton comprises:

a plurality of panels extending at least partially around an interior of the carton, the plurality of panels comprises a top panel, a first side panel foldably connected to the top panel, and a second side panel foldably connected to the top panel;

a handle in at least the top panel, the handle comprises at least one handle flap foldably connected to the top panel at an arcuate fold line, the at least one handle flap is at least partially defined by a cut spaced apart from the arcuate fold line and extending across the top panel and into at least one of the first side panel and the second side panel, the at least one handle flap further comprises at least two arcuate cuts for facilitating positioning of the at least one handle flap, each of the arcuate cuts comprises an end that is proximate to and spaced apart from the cut line, and the at least two arcuate cuts divide the at least one handle flap into three independently foldable portions.

2. The carton of claim 1 wherein the end of a respective arcuate cut is a first end and each arcuate cut comprises a second end, the second end is proximate to and spaced apart from the arcuate fold line.

3. The carton of claim 1 wherein the three independently foldable portions comprise a middle portion defined between the at least two arcuate cuts and two end portions.

4. The carton of claim 3 wherein the middle portion is separated from the two end portions by a respective one of the at least two arcuate cuts.

5. The carton of claim 3 wherein the at least one handle flap further comprises at least two oblique fold lines extending generally between the arcuate fold line and the cut.

6. The carton of claim 5 wherein a respective one of the least two oblique fold lines extends across a respective one of the two end portions.

7. The carton of claim 1 wherein the handle further comprises a first oblique cut and a second oblique cut, the first oblique cut extends from a first end of the arcuate fold line and the second oblique cut extends from a second end of the arcuate fold line.

8. The carton of claim 7 wherein the first side panel is foldably connected to the top panel at a first fold line and the first oblique cut extends to the first fold line.

9. The carton of claim 8 wherein the second side panel is foldably connected to the top panel at a second fold line and the second oblique cut extends to the second fold line.

10. The carton of claim 1 wherein the cut extends into both of the first and second side panels.

11. The carton of claim 1 wherein the at least one handle flap comprises a first handle flap and a second handle flap, the second handle flap being separated from the first handle flap by the cut and being a mirror-image of the first handle flap.

12. The carton of claim 1 further comprising a tear stop in at least one of the first side panel and the second side panel, the tear stop comprises a curved score arranged proximate to a first end of the cut line in the at least one of the first side panel and the second side panel.

13. The carton of claim 12 wherein the tear stop is a first tear stop in the first side panel and the carton further comprises a second tear stop in the second side panel, the second tear stop comprising a curved score arranged proximate to a second end of the cut line in the second side panel.

14. The carton of claim 1 further comprising a dispenser comprising a dispenser panel at least partially defined by a tear line, the dispenser panel is for being at least partially removed from the carton to create a dispenser opening in the carton.

15. The carton of claim 14 wherein the plurality of panels further comprises a first bottom panel foldably connected to the first side panel and a second bottom panel foldably connected to the second side panel, the dispenser panel comprises at least a portion of the second side panel and the second bottom panel.

16. A blank for forming a carton, the blank comprising:

a plurality of panels comprising at least a top panel, a first side panel foldably connected to the top panel, and a second side panel foldably connected to the top panel; and features for forming a handle in at least the top panel, the features for forming the handle comprising at least one handle flap foldably connected to the top panel at an arcuate fold line, the at least one handle flap is at least partially defined by a cut spaced apart from the arcuate fold line and extending across the top panel and into at least one of the first side panel and the second side panel, the at least one handle flap further comprises at least two arcuate cuts for facilitating positioning of the at least one handle flap, each of the arcuate cuts comprises an end that is proximate to and spaced apart from the cut line, and the at least two arcuate cuts divide the at least one handle flap into three independently foldable portions.

17. The blank of claim 16 wherein the end of a respective arcuate cut is a first end and each arcuate cut comprises a second end, the second end is proximate to and spaced apart from the arcuate fold line.

18. The blank of claim 17 wherein the three independently foldable portions comprise a middle portion defined between the at least two arcuate cuts and two end portions.

19. The blank of claim 18 wherein the middle portion is separated from the two end portions by a respective one of the at least two arcuate cuts.

20. The blank of claim 18 wherein the at least one handle flap further comprises at least two oblique fold lines extending generally between the arcuate fold line and the cut.

21. The blank of claim 20 wherein a respective one of the least two oblique fold lines extends across a respective one of the two end portions.

22. The blank of claim 16 wherein the features for forming the handle further comprise a first oblique cut and a second oblique cut, the first oblique cut extends from a first end of the arcuate fold line and the second oblique cut extends from a second end of the arcuate fold line.

23. The blank of claim 22 wherein the first side panel is foldably connected to the top panel at a first fold line and the first oblique cut extends to the first fold line.

24. The blank of claim 23 wherein the second side panel is foldably connected to the top panel at a second fold line and the second oblique cut extends to the second fold line.

25. The blank of claim 16 wherein the cut extends into both of the first and second side panels.

26. The blank of claim 16 wherein the at least one handle flap comprises a first handle flap and a second handle flap, the second handle flap being separated from the first handle flap by the cut and being a mirror-image of the first handle flap.

27. The blank of claim 16 further comprising a tear stop in at least one of the first side panel and the second side panel, the tear stop comprises a curved score arranged proximate to a first end of the cut line in the at least one of the first side panel and the second side panel.

28. The blank of claim 27 wherein the tear stop is a first tear stop in the first side panel and the blank further comprises a second tear stop in the second side panel, the second tear stop comprising a curved score arranged proximate to a second end of the cut line in the second side panel.

29. The blank of claim 16 further comprising features for forming a dispenser comprising a dispenser panel at least partially defined by a tear line, the dispenser panel is for being at least partially removed from a carton erected from the blank to create a dispenser opening in the erected carton.

30. The blank of claim 29 wherein the plurality of panels further comprises a first bottom panel foldably connected to the first side panel and a second bottom panel foldably connected to the second side panel, the dispenser panel comprises at least a portion of the second side panel and the second bottom panel.

31. A method of forming a carton for carrying a plurality of articles, the method comprising:

obtaining a blank comprising a plurality of panels comprising at least a top panel, a first side panel foldably connected to the top panel, and a second side panel foldably connected to the top panel, and features for forming a handle in at least the top panel, the features for forming the handle comprising at least one handle flap foldably connected to the top panel at an arcuate fold line, the at least one handle flap is at least partially defined by a cut spaced apart from the arcuate fold line and extending across the top panel and into at least one of the first side panel and the second side panel, the at least one handle flap further comprises at least two arcuate cuts for facilitating positioning of the at least one handle flap, each of the arcuate cuts comprises an end that is proximate to and spaced apart from the cut line, the at least two arcuate cuts divide the at least one handle flap into the three independently foldable portions; and positioning at least one of the plurality of panels to form the carton having an interior.

32. The method of claim 31 further comprising forming the handle in at least the top panel, the forming the handle comprises positioning the at least one handle flap and dividing the at least one handle flap into three independently foldably portions.

33. The method of claim 32 wherein the three independently foldable portions comprise a middle portion defined between the at least two arcuate cuts and spaced apart from the two end portions by a respective one of the at least two arcuate cuts.

34. The method of claim 31 wherein the handle further comprises a first oblique cut and a second oblique cut, the first oblique cut extends from a first end of the arcuate fold line and the second oblique cut extends from a second end of the arcuate fold line, the method further comprises forming the handle in at least the top panel, the forming the handle comprises separating the at least one handle panel from the top panel at the first oblique cut and the second oblique cut.

35. The method of claim 31 wherein the at least one handle flap comprises a first handle flap and a second handle flap, the second handle flap being separated from the first handle flap by the cut and being a mirror-image of the first handle flap, the method further comprise forming the handle in at least the top panel, the forming the handle comprises separating the first handle flap and the second handle flap along the cut.

* * * * *